US006769285B2

(12) United States Patent
Schneider et al.

(10) Patent No.: US 6,769,285 B2
(45) Date of Patent: Aug. 3, 2004

(54) DEVICE FOR AND METHOD OF TESTING A FIRE ALARM

(75) Inventors: Joachim Schneider, Nattheim (DE); Anton Pfefferseder, Sauerlach-Arget (DE); Bernd Siber, Glonn (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 192 days.

(21) Appl. No.: 09/954,582

(22) Filed: Sep. 17, 2001

(65) Prior Publication Data

US 2002/0047782 A1 Apr. 25, 2002

(30) Foreign Application Priority Data

Sep. 23, 2000 (DE) ..... 100 47 194

(51) Int. Cl.[7] ..... G11N 1/21
(52) U.S. Cl. ..... 73/1.06
(58) Field of Search ..... 73/1.02, 1.03, 73/1.05, 1.06, 1; 374/1

(56) References Cited

U.S. PATENT DOCUMENTS

| | | | | |
|---|---|---|---|---|
| 475,985 A | | 5/1892 | McConnell | |
| 3,693,401 A | * | 9/1972 | Purt et al. | 73/1.05 |
| 5,670,946 A | | 9/1997 | Ellwood et al. | |
| 5,959,188 A | * | 9/1999 | Deutsch et al. | 73/1.06 |
| 6,081,195 A | * | 6/2000 | Lynch | 340/577 |
| 6,107,925 A | * | 8/2000 | Wong | 340/628 |
| 6,424,703 B1 | | 7/2002 | Katz | |

FOREIGN PATENT DOCUMENTS

| | | |
|---|---|---|
| DE | 27 17 014 | 10/1978 |
| DE | 94 08 898 U1 | 11/1995 |
| DE | 198 45 553 A1 | 4/2000 |
| GB | 2 291 189 A | 1/1996 |

* cited by examiner

*Primary Examiner*—Robert Raevis
(74) *Attorney, Agent, or Firm*—Michael J. Striker

(57) ABSTRACT

A device for testing a fire alarm including a smoke alarm and at least one gas sensor, has a testing pot fittable over a fire alarm, a first gas container with aerosol for operational testing of the smoke alarm, the first gas container having a first valve and a first gas outlet opening, the first gas outlet opening extending into the testing part, and means for making available a testing gas for at least one gas sensor available in the testing pot.

17 Claims, 4 Drawing Sheets

DEVICE FOR AND METHOD OF TESTING A FIRE ALARM

BACKGROUND OF THE INVENTION

The present invention relates to a device for and a method of testing a fire alarm.

It is known that fire alarms have to be tested in cyclic time intervals. Some devices and methods for testing fire alarms are known. They can be further improved.

SUMMARY OF THE INVENTION

Accordingly, it is an object of the present invention to provide a device for and a method of testing a fire alarm, which is a further improvement of the existing devices and methods.

In keeping with these objects and with others which will become apparent hereinafter, one feature of present invention resides, briefly stated, in a device for testing a fire alarm, in which the device has at least one testing gas for the at least one gas sensor, which is available in a testing pot.

In accordance with a new method of the invention, together with operational testing of a smoke alarm, an operational testing of at least one gas sensor of the fire alarm is performed with at least one testing gas.

The inventive device and method for testing a fire alarm has the advantage that for a fire alarm, which has a smoke alarm and at least one gas sensor, in one working step the smoke alarm and the at least one gas sensor are tested with respect to their operational ability. Thereby the operational testing of the fire alarm is simplified and accelerated. Moreover, the inventive device represents a testing apparatus which provides all stimuli for the available sensors (smoke alarm, gas sensor, temperature sensor) of the fire alarm.

It is especially advantageous when in accordance with the present invention the aerosol is used for the smoke alarm and the testing gas is used for the at least one gas sensor in separate gas containers in the inventive device, so that individually the gasses are exchangeable and storable individually.

Moreover, advantageously the at least one testing gas and the aerosol can be stored in one gas container, so that space for a further gas container in the inventive arrangement is saved. This simplifies the storage and the replacement of the aerosol with the testing gas. It is further advantageously possible that the testing gas and the aerosol are identical, which significantly saves the expenses for the construction and the operation of the inventive device.

It is further advantageous when as the testing gas, methanol or ethanol or hydrogen are utilized, which due to a cross sensitivity of the gas sensors are usable for the operational testing. Cross sensitivity of a gas sensor means that a gas sensor supplies a detection signal not only for the gas for which it is designed but also for another gas, wherein methanol, ethanol and hydrogen are especially suitable for this purpose. There is therefore the advantage that the hydrogen which is generally difficult to store, here is recovered for the operational testing by electrolysis from a sodium sulfate solution to make the hydrogen available only when needed. The alcohols such as methanol and ethanol provide in addition the possibility to operate as aerosols.

Its another advantage that a gas outlet opening is oriented to a temperature sensor of the fire alarm, to force a temperature lowering at the temperature sensor through the gas outlet, which is usable for an operation test of the temperature sensor. Thereby three different measuring principles are tested in a single step at the fire alarm with respect to its operational ability.

It is further advantageous when the valves are operated mechanically or electromechanically. With an automatic actuation, timely opening sequences are adjustable, which are considered as advantageous for an optimal simultaneous testing of the smoke alarm and the gas sensor. Thereby the use of the testing gas and aerosol can be optimized.

In accordance with another feature of the present invention, it is advantageous when the gas containers are formed as spray boxes. Thereby the mounting and the use of them are significantly simplified.

Finally, it is advantageous when in accordance with the present invention a fire alarm which must be tested with respect to its operational ability is provided with means for switching to one testing mode, and also has means for signaling whether the fire alarm is operational or not. It is especially advantageous to determine which sensor of the smoke alarm, the at least one gas sensor or the temperature sensor, are operational or not. This can be provided in connection with a safety network which is monitored by a central unit and to which the alarm to be tested is connected. The fire alarm in the testing mode signals to the central unit whether the operational ability of the available sensors (smoke, gas, temperature) is provided or not. As a safety network, for example the known LSN (local safety network)-bus can be used.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

In future it is to be expected that in addition to pure smoke alarms for a fire detection, also combined fire alarms are used, which in addition to the smoke alarm has one or several gas sensors, which react to gaseous combustion products produced during a fire. Such combustion products are for example carbon dioxide, carbon monoxide, or nitrogen oxide. The great advantage of this combined alarms is that, with the recovered multiple information a reliable alarm is provided. Since however such fire alarms must be tested in periodic time intervals with respect to their testing the fire alarm are proposed. They make possible testing of the available sensors in a fire alarm simultaneously with respect to their operational ability.

Figure 1:
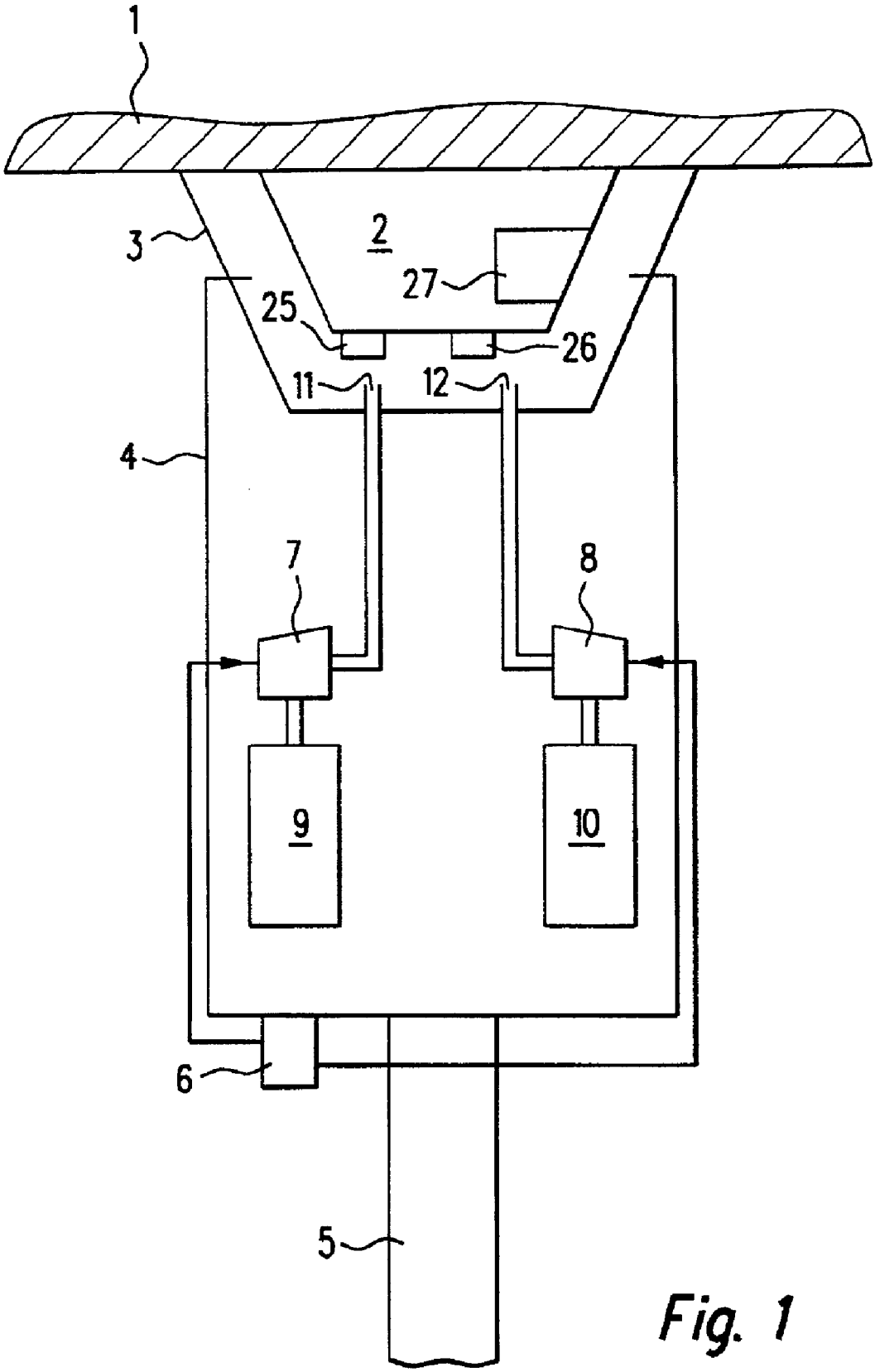
FIG. 1 is a view showing a first embodiment of a device for testing a fire alarm in accordance with the present invention.

FIG. 1 shows a first embodiment of the inventive device for testing a fire alarm. The fire alarm 2 is mounted on a wall or a ceiling 1. The fire alarm 2 has a temperature sensor 25, a gas sensor 26 and a smoke alarm 27. The smoke alarm is here an optical measuring chamber, to which a labyrinth-like path leads. This is a dispersion light alarm. The fire alarm 2 can be also provided without the temperature sensor 25 and/or with several gas sensors. The temperature sensor 25, the gas sensor 26 and the smoke alarm 27 are connected with a signal processing unit in the fire alarm 2, so that detection signals can be recognized and provide signaling. The inventive device has a testing pot 3, which is fitted over the fire alarm 2. The housing 4 has gas containers 9 and 10, as well as valves 7 and 8 and conduits through which the aerosol and at least one testing gas are supplied into the testing pot 3. A gas outlet opening 11 is provided for the gas container 9, and a gas outlet opening 12 is provided for the gas container 10, and they extend into the testing pot 3. The aerosol or the testing gas are stored under pressure in the gas containers 9 and 10, so that by opening of the valves 7 and 8 the aerosol or the testing gas are automatically discharged. The overpressure in the gas containers 9 and 10 can be provided by the evaporation pressure of the aerosol or the testing gas. In this embodiment containers 9 and 10 are formed here as spraying boxes.

The conduits to the gas outlet openings 11 and 12 are sealed on the openings by the testing pot 3. The housing 4 is mounted on the testing pot 3. The gas container 9 in the housing 4 has the aerosol which is used for operational testing of the smoke alarm 27. A valve 7 is provided on the gas container 9 and determines the quantity of the aerosol which flows through the gas outlet opening 11. The valve 7 is connected through an electrical connection with a control unit 6 which is mounted on the housing 4. The control unit 6 controls the opening and closing of the valve 7. The control unit 6 is here a programmable structural block, such as a processor, with a corresponding signal processing device for controlling the valves and for processing the control signals which are supplied by an operator of the inventive device.

The gas container 10 has a valve 8 which determines the quantity of the testing gas located in the gas container 10 and flowing through the gas outlet opening 12. The valve 8 is also connected electrically with the control unit 6 by a conductor, so that the control unit 6 controls the opening of the valve 8. The inventive device is held on the fire alarm 2 by a holding rod 5 which is mounted on the housing 4.

It is possible to open and to close the valve 7 and 8 via a mechanical control. For this purpose, for example, corresponding mechanical pulling and lifting devices can be used. The control unit 6 has however an infrared receiver with an opto-electrical convertor and receiving amplifier, for controlling a remote control. The valves 7 and 8 can be controlled with its infrared signals. Also a radio control of the control unit 6 is possible as well. Furthermore, it is possible that the control unit 6 is mounted inside the housing 4, and a sending/receiving station for infrared signals is located outside of the housing 4, or the control unit 6 is controllable through a window via the remote control.

The control unit 6 is especially suitable for controlling the valves 7 and 8 in correct time intervals. This has the advantage that the suitable aerosol density for testing of the smoke alarm can be achieved in a different time interval than the suitable gas concentration for the gas sensor 26. In this case the operator releases at the control unit a program which automatically controls the opening and the closing of the valves. This leads also to a lower consumption of testing gas and aerosol, and increases the standby time of a gas filling.

The aerosol has the action of smoke, so that a smoke alarm can be tested with the aerosol with respect to its operational ability. When the smoke alarm 27 is provided as here with a labyrinth-like path, through which the smoke must penetrate, then here the aerosol must penetrate through this labyrinth-like path to reach the measuring chamber. In the measuring chamber it is determined with an optical measurement whether smoke occurs or not. For this purpose, for example, a transmission measurement is utilized. Frequently, a dissipation light measurement is however used.

The operational ability of the gas sensor 26 of the fire alarm 2 is tested with the testing gas which comes from the outlet opening 12 and is stored in the container 10. The testing gas can contain either the gas to be detected by the gas sensor 26, or a further gas to which the gas sensor 26 reacts with a detection signal. This condition is identified as a cross sensitivity. Such gasses to which a gas sensor is cross sensitive are for example gaseous methanol, ethanol, other alcohols or hydrogen. With the alcohol such as methanol and ethanol, it should be mentioned that these alcohols are easily volatile and thereby convert to a gaseous condition relatively fast. Furthermore, it is possible that the gas which flows out from the gas outlet openings 11 and 12 can be used for operational testing of the temperature sensor 26 located on the fire alarm 2. When a gas flows from a gas outlet opening to the temperature sensor 25, the condensation or evaporization cold is produced, for example for a cold application such as, for example, for cooling at the temperature sensor 25. This cooling is so fast that under normal operational conditions it does not occur. Therefore this fast temperature drop can be used for an operational testing of the temperature sensor 25.

Figure 2:
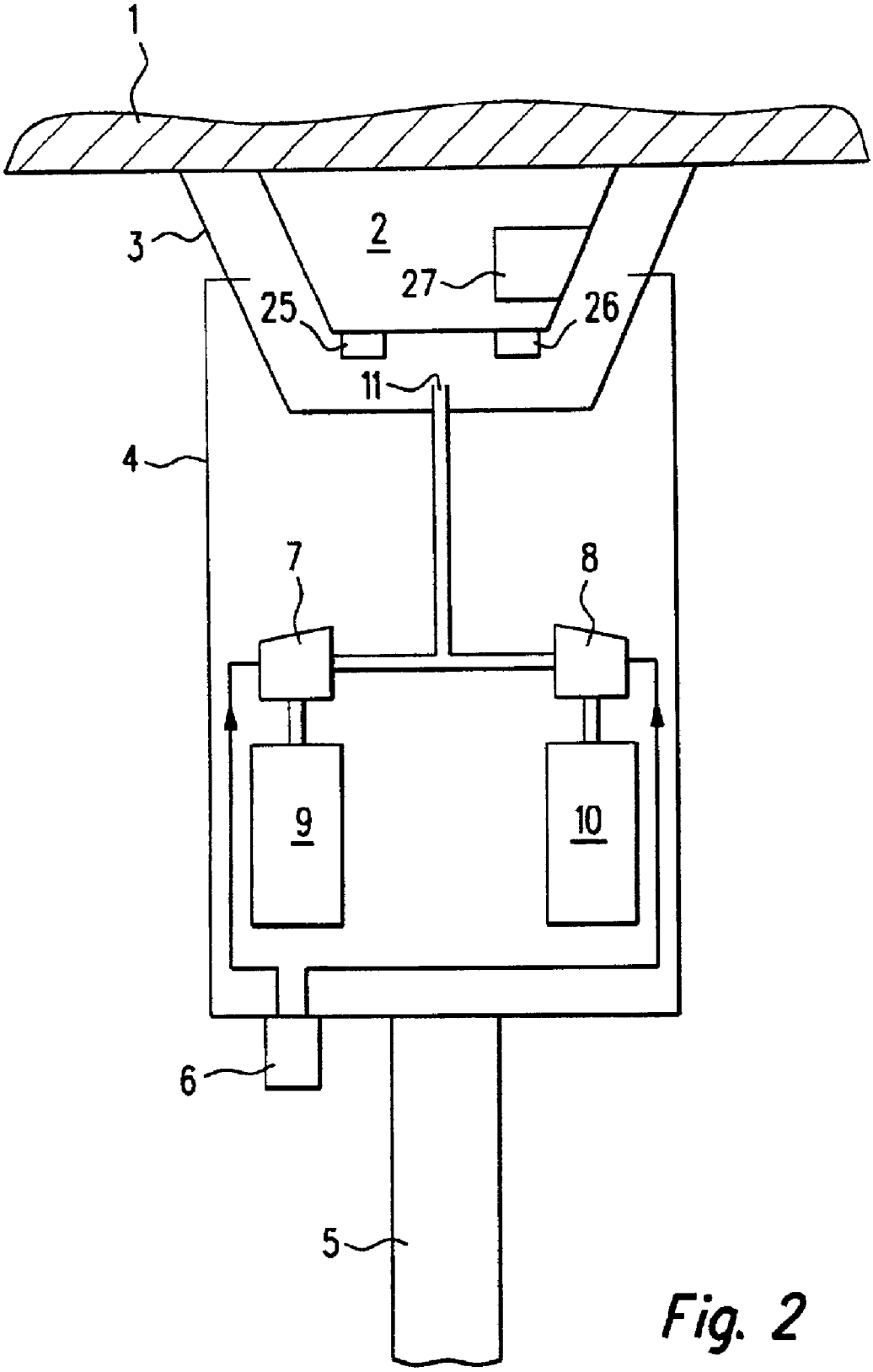
FIG. 2 is a view illustrating a second embodiment of the inventive device for testing the fire alarm.

FIG. 2 shows a second embodiment of the inventive device for testing a fire alarm. The fire alarm 2 is mounted on the wall 1. The fire alarm 2 has the temperature sensor 25, the gas sensor 26, and the smoke alarm 27. The testing pot 3 of the inventive device is fitted over the fire alarm 2. The gas outlet opening 11 extends into the testing pot 3, and both the aerosol from the gas container 9 and the testing gas from the gas container 10 reach the testing pot 3 through it. The gas containers 9 and 10 as well as the valves 7 and 8 are located inside the housing 4, which is mounted on the testing pot 3. Furthermore, the control unit 6 which controls the valves 7 and 8 is located on the housing 4. The housing 4 with the testing pot 3 is held by the holding bar 5 which is mounted on the housing 4. The valves 7 and 8 supply both the testing gas and the aerosol via a common conduit to the gas outlet opening 11.

Figure 3:
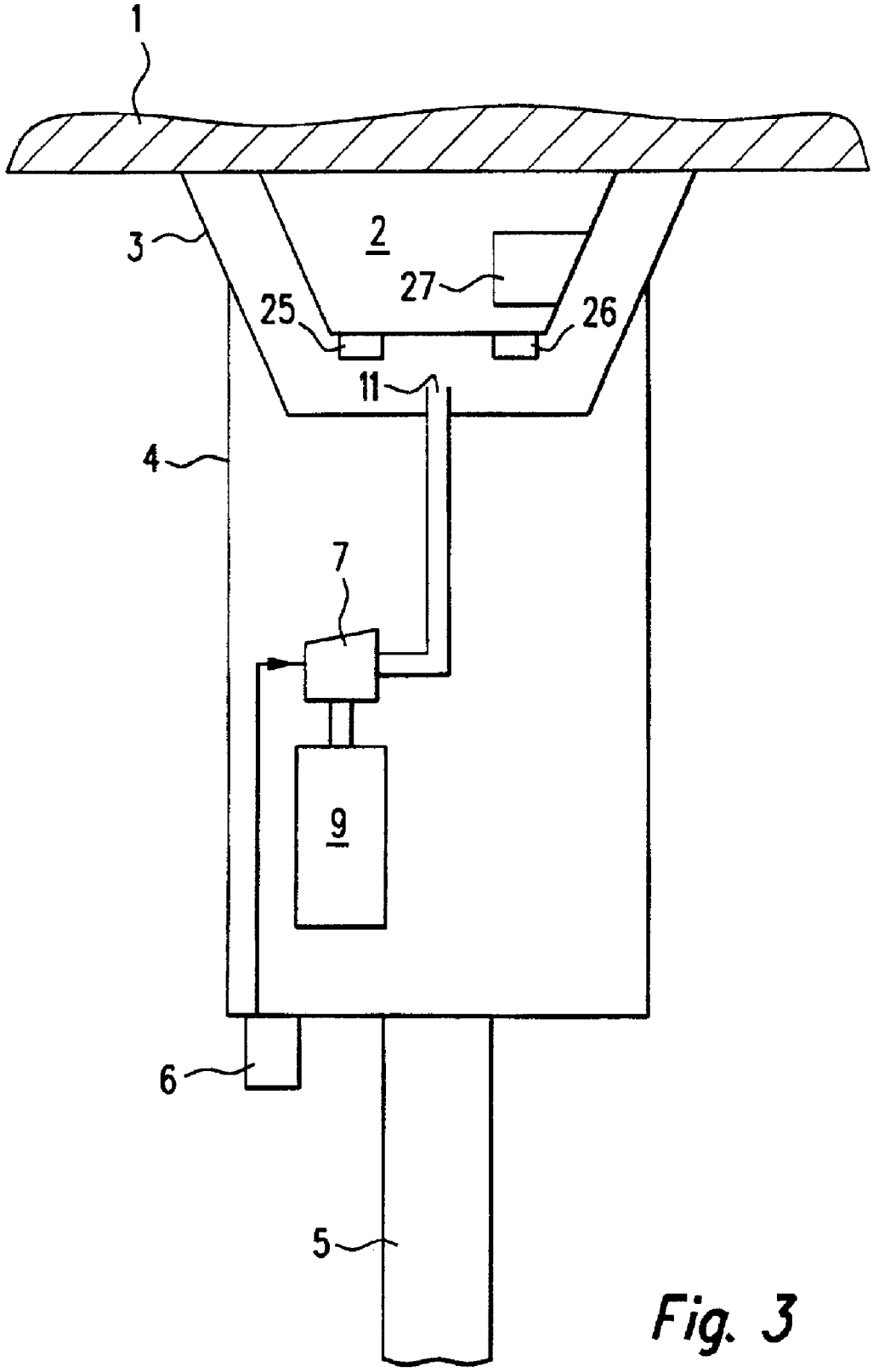
FIG. 3 is a view illustrating a third embodiment of the inventive device for testing the fire alarm.

FIG. 3 shows a third embodiment of the inventive device for testing the fire alarm. The fire alarm 2 is here mounted on the wall 1. The fire alarm 2 has the temperature sensor 25, the gas sensor 26, and the smoke alarm 27. The testing pot 3 is fitted over the fire alarm 2. The housing 4 of the inventive device is mounted on the testing pot 3. The holding rod 5 is also mounted on the housing 4, so as to hold the inventive device. The evaluating unit 6 is placed on the housing 4 and controls the valve 7 inside the housing. The valve 7 belongs to the gas container 9 which contains both the aerosol and the testing gas. This gas mixture is supplied through the valve 7 to the gas outlet opening 11 which extends in the testing pot 3 for performing the operation test of the fire alarm 2. The aerosol can be a complex hydrocarbon compound, but also can be an alcohol such as methanol, ethanol or propanol to be used simultaneously as an aerosol and a testing gas. Then the fast evaporation of these alcohols during the testing process is provided. It is important that a sufficient quantity of alcohol as the aerosol can be supplied into the measuring chamber of the fire alarm 2, to cause a detection signal.

Figure 4:
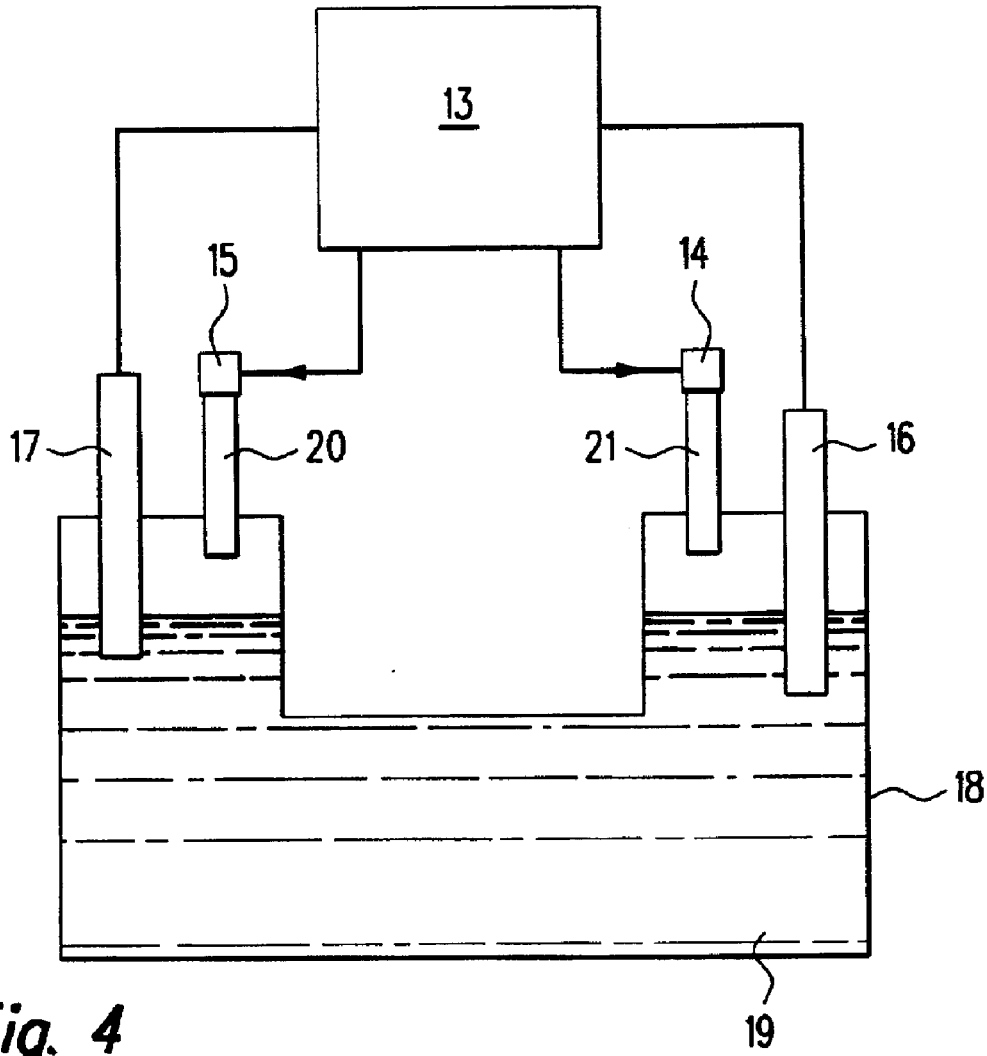
FIG. 4 is a view illustrating an electrolysis unit of the inventive testing device.

FIG. 4 shows an electrolysis unit, with which the hydrogen as a testing gas can be generated and then used as a testing gas for the gas sensor 26 of the fire alarm 2. A control unit 13 is connected with electrodes 16 and 17 which extend into a vessel 18 and inside a sodium sulfate solution 19. The control unit 13 is integrated in the control unit 6. Alternatively, it is possible that the control unit 6 and the control unit 13 are formed as separate, but electrically connected components. The electrolysis unit, instead of the gas container for the testing gas, can be accommodated in the housing 4.

The plus pole is connected with one of the electrodes 16 or 17, while the minus pole is connected with the other electrode, so that a reduction or an oxidation can occur. It leads on the one hand to a release of hydrogen in two-atom form and of oxygen in two-atom form. These gasses are supplied through the gas pipes 20 and 21 from the vessel 18 outwardly. A valvel 15 is located at the gas pipe 20 and controlled by the control unit 13, while a valve 14 is located on the gas pipe 21 and also controlled by the control unit 13. The released oxygen can be simply released to atmosphere, while the released hydrogen is supplied as a testing gas into the testing pot 3. This device for electrolysis can be accommodated in the housing 4, instead of the gas container 10. This has the advantage that hydrogen must no longer be stored but produced only when needed.

Figure 5:
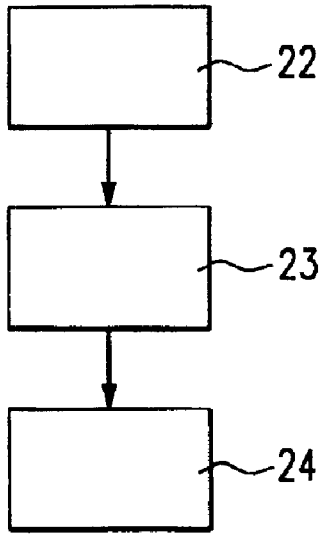
FIG. 5 is a flow diagram of the method for testing a fire alarm in accordance with the present invention.

FIG. 5 shows the inventive method in form of a flow diagram. In the method step 22 the inventive arrangement is fitted over the fire alarm 2 for testing the fire alarm. The fire alarm 2 is switched to a testing mode either by the testing device which actuates a magnetic switch during fitting, or by the central unit which converts for the testing process all alarms to be tested to the testing mode. For this purpose the fire alarm 2 has a communication block and a processor for receiving data from the central unit and for interpreting the data. The communication block is utilized for transmitting the measuring results to the central unit.

In the method step 23 the operational test is performed as explained above. Both the aerosol for the operational test of the smoke alarm 27 and also a testing gas for the operational testing of the gas sensor 26 are utilized, and the signaling signals of the fire alarm 2 are tested, whether the operational ability takes place. In some cases, an available temperature sensor 25 can be tested in the above described manner. The fire alarm 2 can be connected with a central unit through a bus or a conductor, to further supply the measuring results to the central unit. Alternatively, it is possible that the fire alarm 2 has means for signaling, for example an indicator or a loud speaker. The operational abilities of the individual sensors are represented by this means for signaling. In the method step 24 finally the measuring results are picked up.

It will be understood that each of the elements described above, or two or more together, may also find a useful application in other types of constructions differing from the types described above.

While the invention has been illustrated and described as embodied in device for and method of testing a fire alarm, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for testing a fire alarm including a smoke alarm and at least one gas sensor, the device comprising a testing pot fittable over a fire alarm; a first gas container with aerosol for operational testing of the smoke alarm, said first gas container having a first valve and a first gas outlet opening, said first gas outlet opening extending into said testing pot; and means for making a testing gas for at least one gas sensor available in said testing pot.

2. The device as defined in claim 1; and further comprising a second gas container for at least one testing gas, said second gas container being provided with a second valve.

3. The device as defined in claim 2, wherein said first and second valves are controllable in a manner selected from the group consisting of a mechanical control and an electro mechanical control.

4. The device as defined in claim 2, and further comprising a control unit which controls at least one of said first and second valves.

5. The device as defined in claim 2, wherein at least one of said first and second gas containers is formed as a spray box.

6. The device as defined in claim 2, wherein said second gas container is connected with said first gas outlet opening.

7. The device as defined in claim 2, wherein said second gas container has a second outlet opening.

8. The device as defined in claim 1, wherein said first gas container accommodates at least one testing gas which is used as an aerosol.

9. The device as defined in claim 1, wherein said first gas container contains a testing gas which is selected from the group consisting of methanol and ethanol.

10. The device as defined in claim 1, wherein the means for making the testing gas is an electrolysis unit for producing hydrogen as at least one testing gas.

11. The device as defined in claim 10, wherein said electrolysis unit has an aqueous sulfate solution.

12. The device as defined in claim 1, wherein said first gas outlet opening is oriented to a temperature sensor of the fire alarm.

13. The method of testing a fire alarm, comprising the steps of performing an operational testing of at least one smoke alarm of the fire alarm with an aerosol, performing an operational testing of at least one gas sensor of the fire alarm with at least one testing gas, and using an alcohol selected from the group consisting of methanol and ethanol for testing the at least one gas sensor.

14. A fire alarm for performing the method of claim 13, comprising means for switching a testing mode and means for signaling an operational ability of the alarm.

15. A method of testing a fire claim, comprising the steps of performing an operational lusting of at least one smoke alarm of the fire alarm with an aerosol, performing an operational testing of at least one gas sensor of the fire alarm with at least one testing gas, and using an alcohol selected from the group consisting of methanol and ethanol for tasting of the at least one gas sensor.

16. A method of testing a lire alarm, comprising the steps of performing an operational testing of at beet one smoke alarm of the tire alarm with an aerosol, performing an operational tasting of at least one gas sensor of the fire alarm with a least one testing gas, and operationally testing a temperature sensor of the tire alarm by a temperature reduction with a testing gas which as sprayed on the temperature sensor and selected from the group consisting of the aerosol, at least one testing gas, and both.

17. The method of testing afire alarm, comprising the steps of performing an operational testing of at least one smoke alarm of the fire alarm with an aerosol, and performing an operational testing of at least one gas sensor of the fire alarm with at least one testing gas; and operationally testing a temperature sensor of the fire alarm by a temperature reduction with a testing gas which is sprayed on the temperature sensor and selected from the group consisting of the aerosol, at least one testing gas, and both.

* * * * *